United States Patent [19]

McPeak

[11] 4,213,605

[45] Jul. 22, 1980

[54] NECKBONE AND SHOULDER PROTECTIVE APPAREL FOR BARBELL LIFTERS

[76] Inventor: Walter G. McPeak, 3505 Kilkenny West, Tallahassee, Fla. 32303

[21] Appl. No.: 876,122

[22] Filed: Feb. 8, 1978

[51] Int. Cl.[2] ..... A63B 21/12

[52] U.S. Cl. ..... 272/119; 224/201

[58] Field of Search ..... 272/117, 119, 123, DIG. 4, 272/143; 2/2, 44, 45; 224/5 P, 44.5, 201

[56] References Cited

U.S. PATENT DOCUMENTS

| | | | |
|---|---|---|---|
| 2,385,315 | 9/1945 | Vanasse | 2/2 |
| 2,714,979 | 8/1955 | McCarthy | 2/2 X |
| 3,370,850 | 2/1968 | Moore | 272/119 |
| 3,500,472 | 3/1970 | Castellani | 2/2 |
| 3,679,107 | 7/1972 | Perrine | 224/5 P |
| 3,867,726 | 2/1975 | Owl et al. | 2/2 |
| 4,018,442 | 4/1977 | Galler | 272/123 |

FOREIGN PATENT DOCUMENTS

| | | | |
|---|---|---|---|
| 779572 | 1/1935 | France | 272/119 |

*Primary Examiner*—William R. Browne
*Attorney, Agent, or Firm*—Robert Brown, Jr.

[57] ABSTRACT

A weightlifter's protective gear adapted to releasably support a barbell assembly behind the neck and adjacently above the shoulders during exercises. Specifically, the gear comprises a pair of cushion-lined shield straddling the neck and fitting snugly against the shoulders and the upper front and back body areas of the subject, in combination with an upwardly extending notched projection or projections on the shoulder portions of the shield for supporting the barbell shaft, whereby the entire weight of the assembly is uniformly distributed over the shoulders.

3 Claims, 11 Drawing Figures

FIG. 6
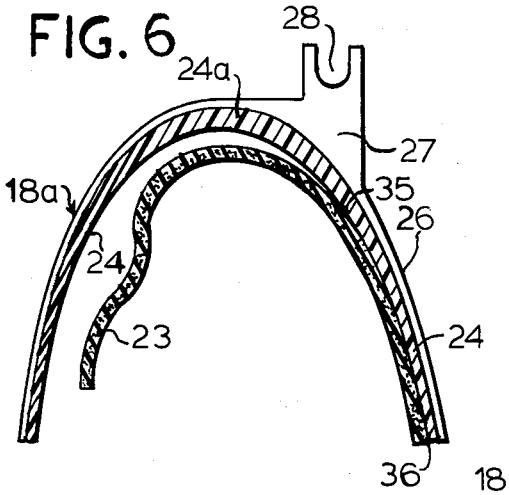
FIG 5
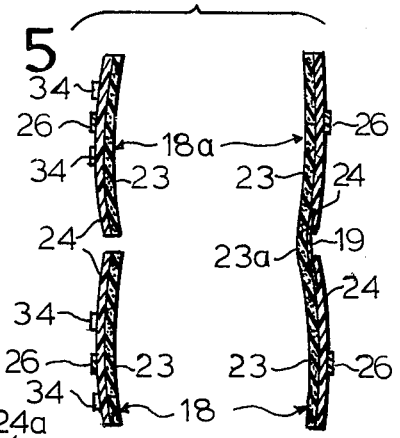
FIG. 8
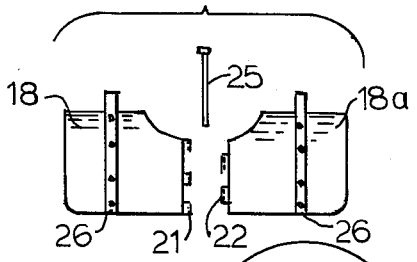
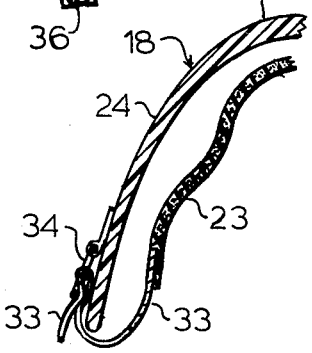
FIG. 7
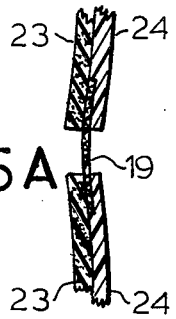
FIG. 5A
FIG. 9
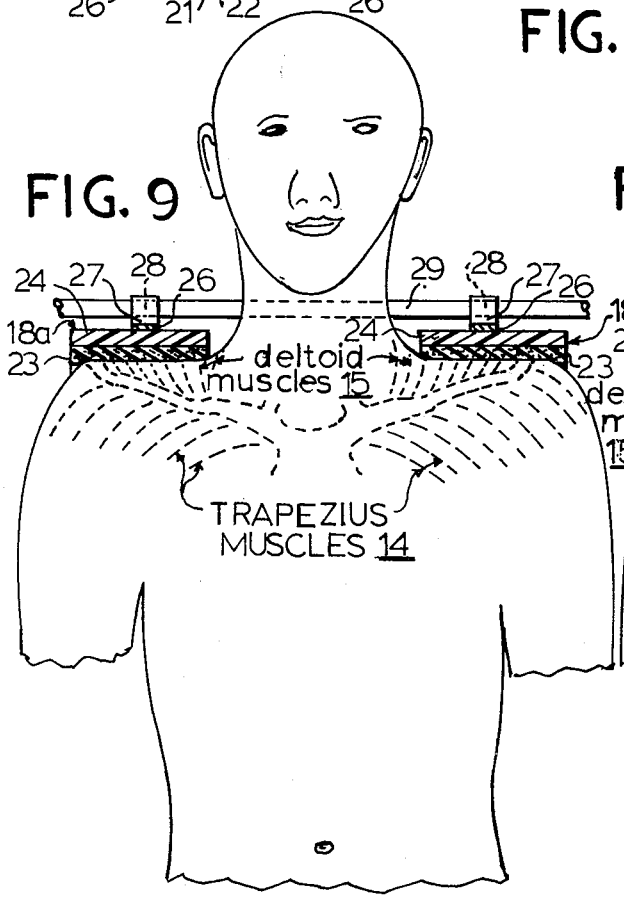
FIG. 10
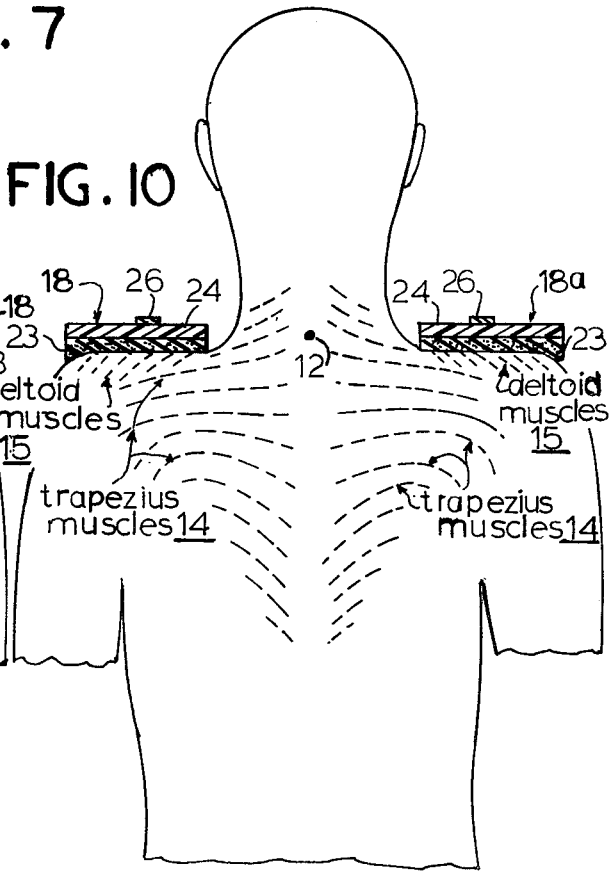

NECKBONE AND SHOULDER PROTECTIVE APPAREL FOR BARBELL LIFTERS

This invention relates to athletic apparel and more especially to a barbell lifter's protective gear for performing squat exercises in which the legs are used to alternately raise and lower the upper portion of the body while maintaining the spine in erect position.

It is common practice during squat exercises for the subject to grip the barbell shaft on opposite sides of his head to maintain side-to-side balance while permitting the intermediate shaft portion to rest upon the shoulders and behind the neck. The weight of the barbell may be varied in a conventional manner to accommodate the strength of the user; however, the maximum weight tends to progressively increase as new competitive records are attained, ranging from six to eight hundred pounds. Obviously, when loads of such magnitude are concentrated upon the relatively small contact area between the shaft and shoulders, intense pain and discomfort is likely to result, in addition to the possibility of injury to the neckbone. Thus, the legs of the subject are often able to lift more weight than his shoulders.

Heretofore, numerous types of weightlifting devices have been provided, such as disclosed in U.S. Pat. Nos. 771,007; 3,322,425; 3,370,850 and 3,679,107, and in Austrain Pat. No. 127,922, but so far as applicant is aware, no exercising device has been constructed in accordance with the present invention or which purports to obviate the above-mentioned problems currently encountered in barbell squat exercises. For example, in U.S. Pat. No. 3,679,107, a unitary yoke is provided which supports a barbell shaft "below the crest of the shoulders of the wearer at predetermined distance down the wearer's back" (col. 2, lines 14–16) and where the the axially extending end portions of the barbell shaft are not within gripping range of the lifter's hands for the purpose of side-to-side balancing. In FIG. 6, column 3, lines 4–10, the shaft is bent to provide side-to-side balancing by having the hands extend downwardly.

It is therefore an object of this invention to provide a protective barbell lifter's apparel which will increase the weightlifting potential of the shoulders and thereby permit the potential of his legs to be more fully utilized.

It is another object of the invention to provide a protective gear for barbell lifters.

It is another object of the invention to provide a protective gear of the class described which may be employed by the subject without altering the procedure or the skill required in using the barbell.

Some of the objects of invention having been stated, other objects will appear as the description proceeds when taken in connection with the accompanying drawings, in which, FIG. 1 is a front view of the barbell protective apparel as worn by the subject;

FIG. 5 is an enlarged sectional detail view taken along lines 5–5 in FIGS. 1 and 3, but omitting the subject;

FIG. 5A is an enlarged sectional detail view through the apparel and similar to FIG. 5, but showing a slightly modified form of cushioned lining or layer;

FIG. 6 is an enlarged sectional detail view taken along line 6—6 in FIG. 1, but showing the apparel removed from the subject and showing the cushioned lining partially separated from the shield;

FIG. 7 is an enlarged sectional detail view taken along line 7—7 in FIG. 1, showing a typical buckle connection between one end of the lining and its associated shield;

FIG. 8 is an exploded view of the article of apparel, showing a modified form of hinge for connecting the shield sections;

FIG. 9 is a diagrammatic front view of the upper front portion of the human body, showing the location of the trapezius muscular areas, and also showing portions of the article in section when resting upon the shoulders under load, and FIG. 10 is a view similar to FIG. 9, but looking at the back of the body.

Figure 1:
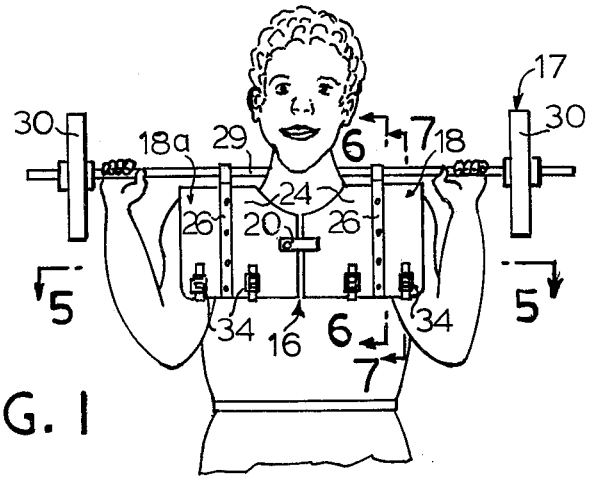

Referring to FIGS. 9 and 10 of the drawings, it will be observed that the trapezius muscular structure 14 and the deltoid muscular structure 15 are each located on the fore and aft shoulder areas of the human body. When executing barbell exercises, the development of, and the proper distribution of weight on these muscles are of critical importance.

The article of apparel broadly designated by the numeral 16 (FIGS. 1–4), functions to uniformly distribute the weight of the barbell assembly 17 over the trapezius and deltoid muscular areas, and at the same time protect these and other body structure, such as the neckbone 12 (FIG. 10) from injury. More specifically, the article 16 comprises two opposite-hand shoulder sections **18, 18*a* having their proximate back edges hingedly connected by means such as a leather strap 19 (FIGS. 2 and 5), said hinge being located midway between the shoulder blades of the wearer. The front proximate edges of sections 18, 18*a* are releasably fastened by suitable means such as snap fastener 20**, thereby facilitating the donning and discarding of the article.

Figure 2:
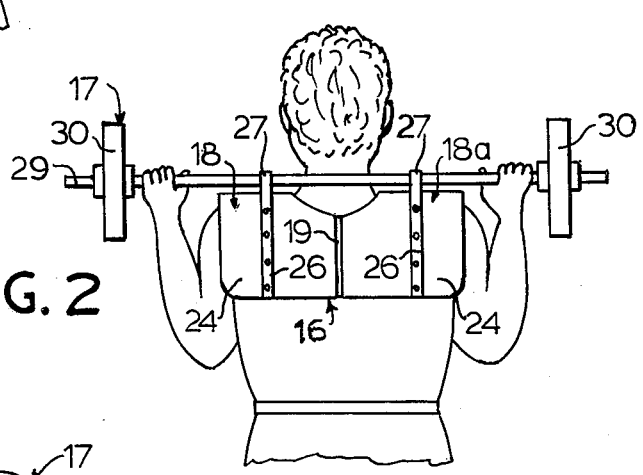
FIG. 2 is a back view of FIG. 1.

Instead of the flexible leather hinge 19 between the sections **18, 18*a* as shown in FIG. 2, the rigid hinge shown in FIG. 8 may be employed, the latter being similar to the conventional door hinge and comprising interfitting lugs 21, 22 rotatably connected by a pin 25**.

Figure 4:
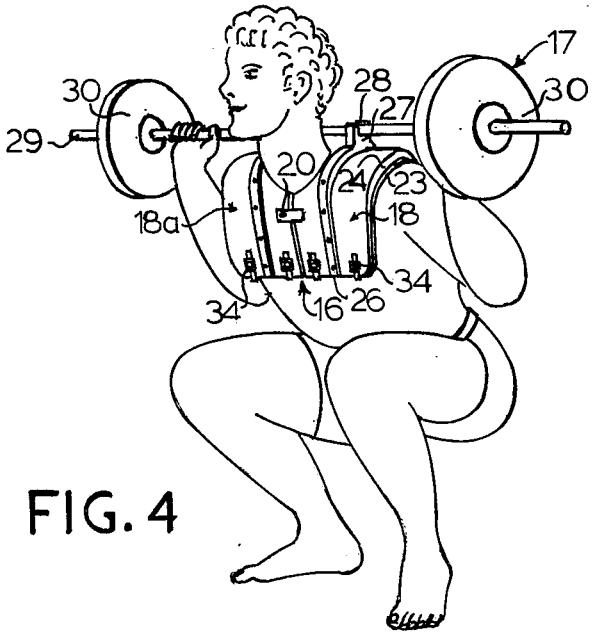
FIG. 4 is a perspective view of FIG. 1, but showing the subject in squat position.
Figure 3:
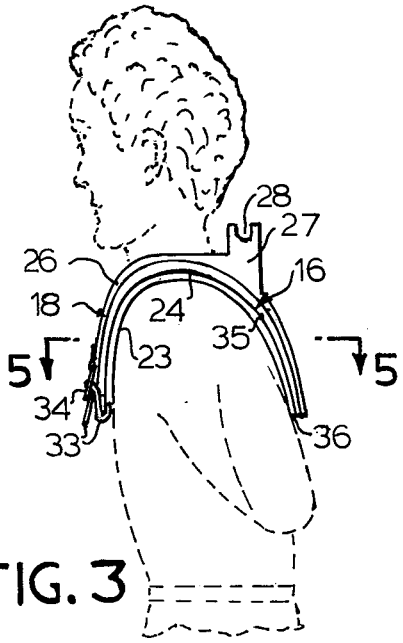
FIG. 3 is a view looking at the right-hand side of FIG. 1, but omitting the barbell assembly.

Each of the shoulder sections **18, 18*a* is composed of a cushioned layer or interwebbing 23 adapted to fold over the shoulder of the wearer with the ipposite ends thereof extending downwardly over the fore and aft upper body surfaces so as to snugly fit against the trapezius and deltoid muscular areas of the shoulder. The layers 23, 23 may be connected as at 23*a* adjacent hinge 19 (FIG. 5), or maintained in two separate sections as shown in FIG. 5A. As best shown in FIGS. 3, 4 and 9, the layers are covered with inverted U-shaped shields 24, 24, said shields being formed from relatively rigid light-weight material such as plastic and shaped to press the underlying cushioned layers 23, 23 into conformity with the above-mentioned shoulder areas while supporting the weight of barbell assembly 17**, described later.

A pair of brackets 26, 26, preferably made of high-strength metal, is secured to said relatively movable shields respectively, each bracket having integral therewith a projection 27 extending upwardly and provided with a notch 28 in its upper end. The notches 28 associated with the two projections 27 are alined with one another and positioned in elevated positions such as will releasably and jointly support the shaft 29 of assembly 17 behind the subject's neck, and adjacently above and substantially parallel to his shoulders (FIGS. 1, 2, 4 and 9). When the shaft is supported in this elevated position, it bridges the neckbone and is prevented from engaging or resting upon either the shoulders or the neckbone 12 (FIG. 10)

The barbell shaft 29 has one or more conventional weights or discs 30 on each of its opposite ends while the intermediate shaft portion rests in notches 28, 28 to be grasped by the wearer's hands.

It will be further observed that brackets 26, 26 and the underlying shields 24, 24 are designed to provide a gear of maximum strength and minimum weight for present purposes. Thus the brackets 24, 24, which are subjected to high unit compressive stresses at notches 28, 28, are made of high-strength metal; and the underlying shields 24, 24, which distribute this same weight over a much larger area, are made of a relatively weaker light-weight material such as plastic. Since the shields also act as a beam when transmitting the weight from the brackets longitudinally of the shoulders, the strength of each shield is increased by providing additional thickness at the concavo-convex shoulder peak portion 24*a* (FIGS. 6 and 7).

Another important feature of the invention resides in the provision of means for permitting the wearer to slidably adjust the layer or lining 23 relative to the overlying surface of shield 24 when the apparel is under the load of the bellbar assembly 17. To provide such means, the cushioned layer 23 is securely fastened in face-to-face contact with the shield 24 between points 35 and 36 (FIG. 6), but leaving the layer detached over the remaining concave shield surface. When the unloaded article 16 is initially donned by the wearer, the entire length of each layer 23 is lightly compressed between the shields and the shoulder surfaces. When, however, the article is subjected to the weight of the assembly 17, there is a tendency for ribs and creases to form in the layers as they seek to conform to the irregularities in the shoulder surface areas, thereby causing pain or discomfort to the wearer. To remedy this condition, the ront lower end of each layer 23 is provided with a pair of straps 33, 33, the free end of each strap being adapted to pass through a slide buckle 34 secured upon the lower front surface of the associated shield (FIG. 7). By conveniently arranging the buckles, the weightlifter is able to tighten the linings while under load so as to eliminate discomfort and provide uniform interfacial contact between the linings and the wearer's trapezius and deltoid muscular areas.

I claim:

1. A neck and shoulder protective apparel (16) for lifters of a barbell assembly (17) during squat exercises, said assembly including a shaft (29) having at least one weight member (30) mounted on each of its opposite end portions, said apparel comprising:

(a) a cushioned layer (23) adapted to fit over each of the lifter's shoulders, the opposite end portions of each layer extending downwardly over the front and back trapezius and deltoid muscle areas (14, 15) of its associated shoulder;

(b) a pair of inverted U-shaped rigid shields (18, 18*a*) covering said layers respectively;

(c) means (26, 26) carried by said shields for jointly supporting the intermediate portion of said shaft (29) with said weight members (30) thereon adjacently behind the lifter's neck, above his neckbone (12), and substantially parallel to and above the crests of his shoulders, the opposite end portions of said shaft axially projecting sidewise beyond the shoulders and within gripping range of the lifter's hands;

(d) means (35, 36) for fixedly securing each of said downwardly extending back end portions of said layers (23, 23) to the proximate face of the associated shield, and (e) means (33, 34) for slidably adjusting a detached, downwardly extending front end portion of each of said layers relative to the proximate face of its associated shield, said adjusting means including a flexible member being attached at one end to one layer and the opposite end being attached to the associated shield.

2. A neck and shoulder protective apparel (16) for lifters of a barbell assembly (17) during squat exercises, said assembly including a shaft (29) having at least one weight member (30) mounted on each of its opposite end portions, said apparel comprising:

(a) a cushioned layer (23) adapted to fit over each of the lifter's shoulders, the opposite end portions of each layer extending downwardly over the front and back trapezious and deltoid muscle areas (14, 15) of its associated shoulder;

(b) a pair of inverted U-shaped shields (18, 18*a*) covering said layers respectively;

(c) means (26, 26) carried by said shields for jointly supporting the intermediate portion of said shaft (29) with said weight members (30) thereon adjacently behind the lifter's neck, above his neckbone (12), and substantially parallel to and above the crests of his shoulders, the opposite end portions of said shaft axially projecting sidewise beyond the shoulders and within gripping range of the lifter's hands;

(d) means (19) for hingedly securing said shields (18, 18*a*) for relative rotation about an axis between the back marginal edges thereof;

(e) means (20) for releasably fastening the proximate front marginal edges of said shields to one another;

(f) means (35, 36) for fixedly securing each of said downwardly extending back end portions of said layers (23, 23) to the proximate face of the associated shield, and (g) means (33, 34) for slidably adjusting a detached downwardly extending front end portion of each of said layers relative to the proximate face of its associated shield, said adjusting means including a flexible member being attached at one end to one layer and the opposite end being attached to the associated shield.

3. A neck and shoulder protective apparel (16) for lifters of a barbell assembly (17) during squat exercises, said assembly including a shaft (29) having at least one weight member (30) mounted on each of its opposite end portions, said apparel comprising:

(a) a cushioned layer (23) adapted to fit over each of the lifter's shoulders, the opposite end portions of each layer extending downwardly over the front and back trapezius and deltoid muscle areas (14, 15) of its associated shoulder;

(b) a pair of inverted U-shaped rigid shields (18, 18*a*) covering said layers respectively;

(c) means (26, 26) carried by said shields for jointly supporting the intermediate portion of said shaft (29) with said weight members (30) thereon adjacently behind the lifter's neck, above his neckbone (12), and substantially parallel to and above the crests of his shoulders, the opposite end portions of said shaft axially projecting sidewise beyond the shoulders and within gripping range of the lifter's hands; said last-named means (26, 26) including a pair of alined notched projections (27, 27) integral with and projecting upwardly above the crests of said shields respectively;

(d) means (35, 36) for fixedly securing each of said downwardly extending back end portions of said layers (23, 23) to the proximate face of the associated shield, and (e) means (33, 34) for slidably adjusting a detached downwardly extending front end portion of each of said layers relative to the proximate face of its associated shield, said adjusting means including a flexible member being attached at one end to one layer and the opposite end being attached to the associated shield.

* * * * *